US008916023B2

(12) United States Patent
Greenwood

(10) Patent No.: US 8,916,023 B2
(45) Date of Patent: Dec. 23, 2014

(54) VAPOR PHASE HYDROLYSIS VESSEL AND METHODS RELATED THERETO

(75) Inventor: Brian F. Greenwood, Cumming, GA (US)

(73) Assignee: Andritz, Inc., Glens Falls, NY (US)

( * ) Notice: Subject to any disclaimer, the term of this patent is extended or adjusted under 35 U.S.C. 154(b) by 0 days.

(21) Appl. No.: 13/405,921

(22) Filed: Feb. 27, 2012

(65) Prior Publication Data

US 2012/0234511 A1 Sep. 20, 2012

Related U.S. Application Data

(60) Provisional application No. 61/454,055, filed on Mar. 18, 2011.

(51) Int. Cl.

| | |
|---|---|
| ***D21C 3/26*** | (2006.01) |
| ***D21C 1/02*** | (2006.01) |
| ***D21B 1/02*** | (2006.01) |
| ***D21C 3/02*** | (2006.01) |

(52) U.S. Cl.

CPC *D21C 1/02* (2013.01); *D21B 1/021* (2013.01); *D21C 3/02* (2013.01)

USPC ..... 162/19; 162/237

(58) Field of Classification Search

CPC ..... D21C 3/02; D21C 1/02; D21B 1/021

USPC ..... 162/19, 237

See application file for complete search history.

(56) References Cited

U.S. PATENT DOCUMENTS

| | | | | |
|---|---|---|---|---|
| 3,380,883 | A * | 4/1968 | Richter et al. | 162/19 |
| 5,454,490 | A * | 10/1995 | Johanson | 222/146.4 |
| 2004/0060673 | A1* | 4/2004 | Phillips et al. | 162/22 |
| 2011/0192560 | A1* | 8/2011 | Heikkila et al. | 162/29 |

* cited by examiner

*Primary Examiner* — Jacob Thomas Minskey

(74) *Attorney, Agent, or Firm* — Nixon & Vanderhye P.C.

(57) ABSTRACT

A prehydrolysis of wood chips or other lignocellulosic material in a vessel having a gaseous portion and a liquid portion. The vessel includes at least one stress relieving piece that inhibits overcompression of the lignocellulosic material. The vessel operates in a continuous process. A slurry of lignocellulosic material and liquid is removed from the bottom of the vessel.

14 Claims, 2 Drawing Sheets

VAPOR PHASE HYDROLYSIS VESSEL AND METHODS RELATED THERETO

This application claims the benefit of priority to U.S. App. No. 61/454,055 filed on Mar. 18, 2011, the entire contents of which is incorporated herein by reference.

BACKGROUND OF THE INVENTION

This invention generally relates to the dissolving pulp cooking and particularly with pre-hydrolysis and Kraft cooking.

A pre-hydrolysis of wood chips for the removal of hemicelluloses prior to Kraft cooking may be required in one method of producing pulps having a high alpha cellulose content (e.g., greater than 94% alpha cellulose). Pulps with such high alpha cellulose content are typically referred to as dissolving pulps and may be used in the production of rayon, acetate and other products.

A conventional method of carrying out the pre-hydrolysis of wood chips involves contacting the wood chips with a liquid (water) environment at temperatures in the range of 150-170° C. One disadvantage to the liquid surrounding the wood chips is that there is an opportunity for the byproducts of the pre-hydrolysis reaction to diffuse from the wood chips into the surrounding liquor. These byproducts consist of various sugars such as xylose, furfural, arabinose, mannose, galactose, as well as acetic acid, other organic acids and lignin fragments.

The released acids can lower the pH of the mixture to the range of 3.3-3.7, such lowered pH further driving the hydrolysis reaction. The hemicelluloses are generally present as monomers and oligomers and more complex molecules.

Under the pH and temperature conditions of the reaction, and particularly higher temperatures, some of the complex molecules and lignin fragments undergo condensation reactions and combine into higher molecular weight molecules (pseudo-lignin, lignin and other condensation reaction byproducts) which are susceptible to precipitation on the surface of the equipment and the wood chips.

The precipitation onto the surface of the equipment, particularly liquor extraction screens, can make the operation unstable and can force premature stoppage of the process or switching to another mode of operation for cleaning of the equipment.

Methods of pre-hydrolysis and/or other known apparatuses are described, for example, in U.S. Pat. No. 6,280,569 to Sheerer; U.S. Pat. No. 5,985,096 to Marcoccia et al.; U.S. Pat. No. 5,676,795 to Wizani et al.; U.S. Pat. No. 5,589,033 to Tikka et al.; U.S. Pat. No. 5,454,490 to Johanson; U.S. Pat. No. 4,028,171 to Richter; U.S. Pat. No. 3,413,189 to Backlund; U.S. Pat. No. 3,380,883 to Richter et al.; U.S. Pat. No. 2,858,211 to Durant et al.; U.S. Patent App. Pub. No. 2011/0180061 to Bolles et al.; and U.S. Patent App. No. 61/445,253 to Leavitt et al. (filed Feb. 22, 2011). In addition, related techniques and apparatuses are described in Leschinsky et al., Formation of Insoluble Components During Autohydrolysis of Eucalyptus Globulus, Lenzinger Berichte 87 (2009) 16-25; Sixta, Multistage Kraft Pulping, Handbook of Pulp, p 325-365 (2006); Rydholm, Chemical Pulping—Multistage Processes, Pulping Processes, p. 655-671 (1965); and Rydholm, Continuous Prehydrolysis-Kraft Cooking, Continuous Pulping Processes, p. 105-120 (1970)

BRIEF DESCRIPTION OF THE INVENTION

In an aspect, an embodiment may relate to a method for hydrolysis in a vessel comprising a vapor portion and a liquid portion. The method may comprise the steps of: feeding lignocellulosic material into a vapor portion of the vessel; supplying gaseous material to the vapor portion of the vessel, such that the lignocellulosic material contacts the gaseous material and a hydrolysis or autohydrolysis reaction occurs; retaining the lignocellulosic material in the vapor portion of the vessel for a period of time between 15 and 180 minutes; preventing overcompression of the lignocellulosic material in the vapor portion of the vessel via at least one column stress relief piece attached to a wall of the vessel, wherein the at least one column stress relief piece has an inward portion that creates a constricted cross-sectional area smaller than a cross-sectional area of the vessel; transferring the lignocellulosic material to a liquid portion of the vessel; supplying liquid to the liquid portion of the vessel; mixing the lignocellulosic material with the liquid to create a slurry; and removing the slurry continuously from the vessel.

In another aspect, an embodiment may generally relate to a system for hydrolysis. The system may include a vessel adapted to receive (i) lignocellulosic material, (ii) at least one gas in an upper portion of the vessel, and (iii) a liquid in a lower portion of the vessel; at least one column stress relief piece attached to a wall of the vessel, wherein the at least one column stress relief piece has an inward portion that creates a constricted cross-sectional area smaller than a cross-sectional area of the vessel, wherein the at least one column stress relief piece is adapted to inhibit compression of the lignocellulosic material in the vessel; a measurement device that measures a level of lignocellulosic material in the vessel that is not submerged in liquid; a stirrer that stirs the liquid and the lignocellulosic material to create a slurry; and an exit stream adapted to remove the slurry from the vessel.

DETAILED DESCRIPTION OF THE INVENTION

Figure 1:
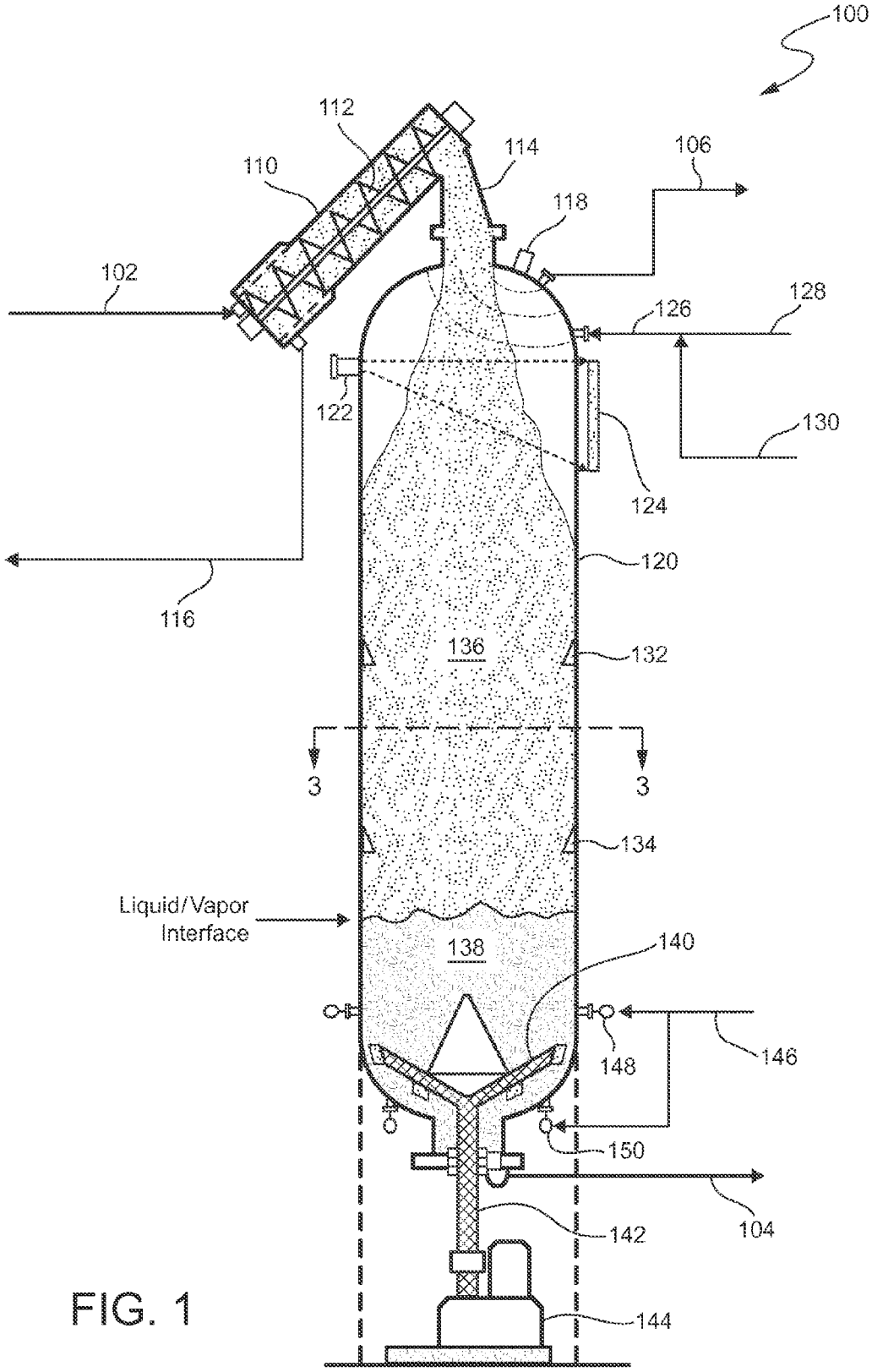
FIG. 1 illustrates a pre-hydrolysis apparatus in accordance with an exemplary embodiment of the invention.

In an aspect, any biomass may be employed in connection with the processes and reactor(s) described herein. For example, the biomass may contain one or more wood(s), grass(es), and/or any lignocellulosic-containing material.

In an effort to overcome the deficiencies of the prior art (e.g., the use of immersion and/or soaking), it may be desirable to reduce the amount of liquid in the pretreatment vessel. This reduced liquid environment may be accomplished by using dry conditions with little or no free liquid. But the absence of liquid can cause a unique set of difficulties, including, for example, transport.

In an aspect of the present invention, a reactor design may alleviate the difficulties. In particular, the chips or other biomass material may contact a liquid at the bottom of the reactor vessel, such that a slurry can be obtained. Furthermore, the liquid may be alkaline, such that the hydrolysis or autohydrolysis is stopped or otherwise inhibited.

In accordance with an exemplary embodiment, an alternative to water prehydrolysis is steam phase prehydrolysis. In which the chips are treated in a gas/steam phase at temperatures between 150-175° C. for a period of 60-90 minutes. An advantage of this mode of operation is that the majority of byproducts of the hydrolysis reaction remain within the chips during the time that the chips remain in the steam environment.

In another aspect, the technique need not include an attempt to extract the hydrolysate from the process. Accordingly, the design can omit extraction screens which when present, in a liquid phase system, have a tendency to plug with precipitated pseudo lignin, lignin and other byproducts of hydrolysis and subsequent condensation reactions. Of course, an extraction screen may be present, if desirable (e.g., in the liquid section and/or dilution zone).

In the lower part of the vessel, a liquid level or dilution zone is maintained. The preferred pH of the dilution zone is 12 or above (e.g., 13 or above) with the alkalinity achieved by the addition of white liquor or sodium hydroxide to the transfer circulation. Lower pH levels may also be used (e.g., 8 or above, 9 or above, 10 or above, 11 or above, etc.) although the level preferably remains sufficiently high to prevent the build-up of precipitated condensation products in the dilution zone.

The majority of the byproducts of the hydrolysis remain within the chips as the chips enter the dilution zone. At that point the acidity may be neutralized and in the preferred case shifted to an alkaline state, e.g., a strong alkaline state. The byproducts of hydrolysis may begin to diffuse out the chips and into the liquid phase. Those byproducts that may have condensed into larger molecules with a tendency to precipitate on solid surfaces when in acidic conditions are more soluble and tend to remain in solution under strong alkaline conditions.

A problem with treatment of a column of wood chips in a steam phase is that the weight of the column of wood chips can in some instances lead to compressive forces on the column which cause bridging and hold-up of the column, possibly preventing stable operation. In this design, these forces may be relieved by the installation of stress relief pieces which are modest inward steps, preferably mounted at 2-6 levels (e.g., 2 levels, 3 levels, 4 levels, levels, 6 levels, etc.) and which extend partially or entirely around the inner circumference of the vessel. A similar technique has been practiced in some atmospheric pre-steaming bins and is described in U.S. Pat. No. 5,454,490 to Johanson (the entirety of which is incorporated herein by reference) for that application.

These inward steps may prevent overcompression of the biomass in the vapor phase of the vessel.

The straight section of the vessel, e.g., a portion that defines a cylinder, may have a height to diameter ratio of 2:1 to 10:1 (and all subranges therebetween), e.g., preferably 4:1 to 6:1.

The vessel is divided into an upper vapor phase and a lower liquid phase, because the liquid added to the bottom of the vessel does not reach the top of the vessel. Preferably, the liquid phase reaches 0.5 to 5 diameters from the bottom of the vessel (and all subranges therebetween), e.g., more preferably between 1 and 2.5 diameters from the bottom of the vessel.

The liquid phase is preferable alkaline, e.g., as supplied by the transfer system. Any alkaline liquid may be sufficient, including caustic (i.e., sodium hydroxide), cooking liquors (e.g., including sodium hydroxide and/or sodium sulfide), such as white liquor, green liquor, and/or black liquor.

The liquid phase may perform at least one of two functions: (i) stopping the hydrolysis or autohydrolysis of the chips or other lignocellulosic material as begun in the vapor phase of the vessel and (ii) creating a slurry, such that the hydrolyzed and softened chips (or other lignocellulosic material) may be transported via conventional slurry-based methods, such as, for example, a slurry pump.

Upon discharge via the outlet device at the bottom of the prehydrolysis vessel, the hydrolyzed chips may be temporarily stored or may be preferably transferred via conventional means to the top of the Kraft digester vessel. Preferably, the Kraft digester is a steam phase digester vessel using an inverted top separator of the type supplied by Andritz Inc.

The Kraft digester following the prehydrolysis stage may be operated, for example, in any one of several cooking modes such as Upflow Lo-Solids®, Downflow Lo-Solids® or conventional cooking. Due care in operation should preferably be taken to avoid over compaction of the chip column in the digester due to the fact that the prehydrolysis may cause the chips to be in a softer form. Softer chips can be more susceptible to over compaction, which in turn can lead to less stable operation in some instances.

The feed to the vapor phase hydrolysis vessel may be accomplished via any number of techniques. For example, the biomass material may be fed via a gas phase rotary valve with a feed arrangement similar to that used to feed a M&D Style Digester available from Andritz Inc. See U.S. Pat. No. 3,135,651 to Starrett and U.S. Pat. No. 3,219,393 to Starrett, the entirety of both of which are incorporated herein by reference.

For another example, the biomass material may be fed via a standard Andritz digester feed system including a Screw type Airlock, Diamondback® Chip Bin with atmospheric pre-steaming, and using centrifugal pumps in a TurboFeed® (e.g., as described in U.S. Pat. No. 6,106,668 to Stromberg et al. and U.S. Pat. No. 6,841,042 to Stromberg et al., the entirety of both of which are incorporated herein by reference) configuration feeding chips to an inclined top separator or a inverted top separator at the top of the vapor phase hydrolysis vessel.

For yet another example, use of older styles of chip feeding systems may also be used, including those using a rotary style pocket valve known in the pulping industry as a High Pressure Feeder. The feeding system may include a screw press, a plug feeder, or a conveyor, e.g., with a screw auger or belt.

In any case of the feeding system, an objective may be to minimize the amount of free liquid (e.g., water in the preferred case) which is carried into the vapor phase hydrolysis vessel along with the chips.

FIG. 1 illustrates an embodiment of a system 100 that includes a vessel in accordance with an aspect of one embodiment of the present invention. Raw material (e.g., wood chips or other lignocellulosic biomass) is fed via line 102 to inclined separator 110. The raw material moves up screw auger 112, which separates filtrate that exits via line 116 to the feed system. The raw material is fed to the top of vessel 120 through throat 114.

The amount of material fed to vessel 120 may be controlled manually or automatically via a feedback based upon a level of material in the vessel, e.g., as determined either by a microwave level measurement 118 (e.g., an air pulse radar gauge) and/or gamma radiation (e.g., via gamma source 122 and gamma detector 124). Other types of measurement may be used, including monitoring pressure of the based of the vessel, e.g., as described in U.S. App. Pub. No. 2009/0188641 to Tuuri, the entirety of which is incorporated herein by reference.

Vapor (e.g., steam and/or other gaseous material) is added to the vessel 120 via line 128. Compressed air may be added via line 130 to the line 128 prior to addition to the vessel via line 126. The compressed air may provide an overpressure, such that flashing in the vessel can be inhibited by maintaining the pressure above the equilibrium temperature of the liquid in the vessel. Although illustrated as added to the upper portion of the vessel 120, it may be possible to add the gas or gasses below the stress relief pieces 132 and/or 134 (e.g., to create fluid flow to further prevent overcompression of the lignocellulosic material). Preferably, the gas or gasses may be added at any location above the level of the liquid in liquid portion 138. That is, the gas or gasses may be added to any location along vapor portion 136 in vessel 120.

Stress relief pieces 132 and 134 may relieve downward compressive forces on the column of lignocellulosic material, which can cause bridging and hold-up of the column. These forces are relieved by the installation of stress relief pieces 132 and 134 which are modest inward steps, preferably mounted at 2 to 6 separate levels and which partially or entirely extend around the inner circumference of the vessel. A similar technique has been practiced in some atmospheric pre-steaming bins and is described in U.S. Pat. No. 5,454,490 to Johanson (the entirety of which is incorporated herein by reference).

Figure 2:
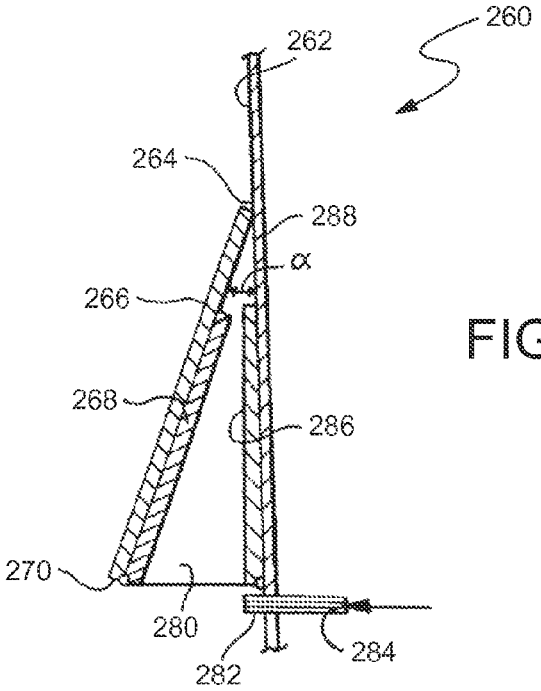
FIG. 2 illustrates a stress relief piece in accordance with an exemplary embodiment of the invention.

FIG. 2 illustrates a stress relief piece 260 in accordance with an exemplary embodiment of the invention. As shown in FIG. 2, the vessel wall 288 has an interior surface 262. The stress relief piece may be seen as a circular cone frustum, e.g., defined by plate 266. A continuous plate curved and formed in a configuration closely approximating a right circular cone frustrum can be provided, or a number of different plates can be combined to form the stress relief piece. Supporting plate 266, there also is preferably a gusset 280 which, as illustrated, has a support plate 268 engaging the plate 266. There is also a supporting plate 286 attached to the interior of the shell 288 (e.g., to surface 262). In order to provide proper support for the plates 266 around the internal circumference of the vessel, a plurality of such gussets and associated plates can be provided. For example, typically 2 to 20 (such as 12) gussets can be provided around the internal circumference of the vessel.

FIG. 2 also schematically illustrates a gas inlet port 284, which may allow for the introduction of stream and/or other gaseous material, such as compressed or uncompressed air. The inlet port 284 penetrates the wall through 282, such that steam or other gaseous material may be supplied below the stress relief piece shown in FIG. 2.

The frustrum-defining plate 266 may preferably form an angle $\alpha$ with respect to the wall 288, e.g., at intersection 264. The angle $\alpha$ may be any angle greater than 0° and less than 90°, (and all subranges therebetween), preferably between 10° and 30°, for example 20°. The angle $\alpha$ will be dependent in part upon the particulate material being contained by the vessel (e.g., wood chips versus other lignocellulosic material, such as grasses) as well as the vessel's height and diameter.

Figure 3:
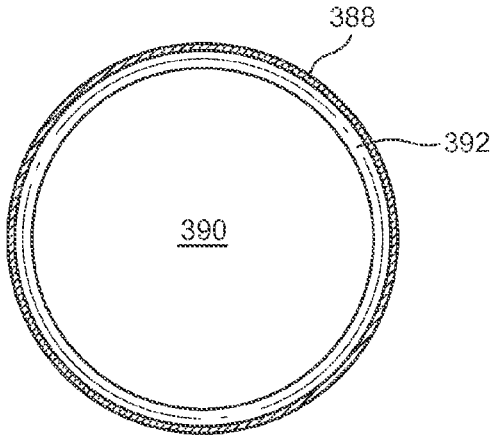
FIG. 3 illustrates a top view of a stress relief piece in accordance with an exemplary embodiment of the invention.

FIG. 3 illustrates a top view of a stress relief piece in accordance with an exemplary embodiment of the invention, as shown by the lines 3-3 in FIG. 1. The vessel has an outer wall 388 and the stress relief piece 392 (e.g., which may be constructed of multiple connected pieces) that engages the internal circumference of the vessel's outer wall. Material flows though the center of the vessel 390.

Figure 4:
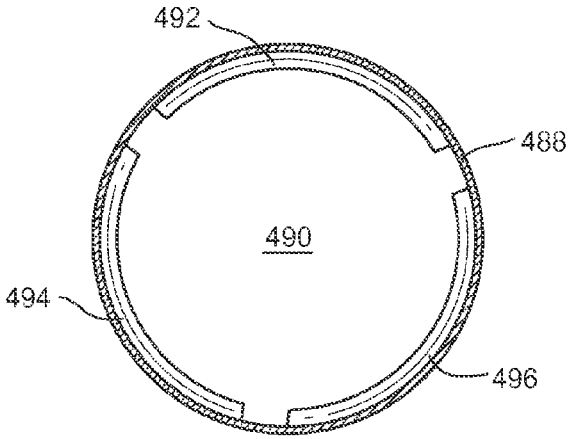
FIG. 4 illustrates a top view of multiple stress relief pieces in accordance with an exemplary embodiment of the invention.

FIG. 4 illustrates a top view of multiple stress relief pieces in accordance with an exemplary embodiment of the invention, similar to FIG. 3. The vessel has an outer wall 488 and the stress relief pieces 492 (e.g., which may be constructed of multiple connected pieces) that engages a portion of the internal circumference of the vessel's outer wall. Material flows though the center of the vessel 490.

Returning to FIG. 1, the lignocellulosic material is preferably retained in the vapor phase portion 136 for between 15 and 180 minutes (and all sub ranges therebetween), more preferably between 30 and 120 minutes (and all sub ranges therebetween), and most preferably between 60 and 90 minutes (and all sub ranges therebetween). The temperature of the vapor phase is preferably between 100 and 200° C. (and all sub ranges therebetween), more preferably between 125 and 175° C. (and all sub ranges therebetween), and most preferably between 150 and 165° C. (and all sub ranges therebetween).

From the vapor phase portion 136, the lignocellulosic material enters the liquid phase portion 138 through the liquid/vapor interface. Liquid—preferably alkaline liquid—enters vessel 120 via line 146, which may be divided between valves 148 and 150. The liquid preferably stops the hydrolysis (or autohydrolysis) reaction and creates a slurry. To facilitate one or both of these functions, a mechanical stirring mechanism 140 may rotate to mix and/or create a generally homogenous slurry via rotation of shaft 142 as driven by motor 144.

The slurry may be removed from vessel 120 via line 104, where it may be stored or, more preferably, transferred to a digester.

It should be noted that the process as described is preferably a continuous process, not a batch process. In this manner, chips or other lignocellulosic material is continuously fed to the top of vessel 120. And the hydrolyzed material is continuously removed from the bottom of the vessel 120. Of course, there may be chips or lignocellulosic material added to the vessel in a slightly discontinuous or discontinuous manner, e.g., via a rotary feeder, where the material is metered and is not continuously fed to the top of the vessel. That is, the operation may include periods of time in which no material is fed to the vessel, even though the vessel contains chips or other lignocellulosic material and material is continuously removed from the vessel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for hydrolysis in a vessel comprising a vapor portion and a liquid portion, the method comprising the steps of:

feeding lignocellulosic material into a vapor portion of the vessel;

supplying gaseous material to the vapor portion of the vessel, such that the lignocellulosic material contacts the gaseous material and such that a hydrolysis or autohydrolysis reaction occurs;

retaining the lignocellulosic material in the vapor portion of the vessel for a period of time between 15 and 180 minutes;

preventing overcompression of the lignocellulosic material in the vapor portion of the vessel via at least one column stress relief piece attached to a wall of the vessel, wherein the at least one column stress relief piece has an inward portion that creates a constricted cross-sectional area smaller than a cross-sectional area of the vessel;

transferring the lignocellulosic material to a liquid portion of the vessel;

supplying liquid to the liquid portion of the vessel;

mixing the lignocellulosic material with the liquid to stop the hydrolysis or autohydrolysis reaction and to create a slurry;

removing the slurry continuously from the vessel; and transferring the slurry to the top of a digester vessel.

2. The method according to claim 1, further comprising the step of supplying water vapor or steam to the vapor portion of the vessel.

3. The method according to claim 1 further comprising the step of retaining the lignocellulosic material in the vapor portion of the vessel for a period of time between 30 and 120 minutes.

4. The method according to claim 1 further comprising the step of retaining the lignocellulosic material in the vapor portion of the vessel for a period of time between 60 and 90 minutes.

5. The method according to claim 1 further comprising the step of retaining the lignocellulosic material in the vapor portion of the vessel at a temperature between 100 and 200° C.

6. The method according to claim 1 further comprising the step of retaining the lignocellulosic material in the vapor portion of the vessel at a temperature between 125 and 175° C.

7. The method according to claim 1 further comprising the step of retaining the lignocellulosic material in the vapor portion of the vessel at a temperature between 150 and 165° C.

8. The method according to claim 1 further comprising the step of supplying alkaline liquid to the liquid portion of the vessel.

9. The method according to claim 8, wherein the step of supplying alkaline liquid to the liquid portion of the vessel creates a pH of the liquid at 12 or above.

10. The method according to claim 8, wherein the step of supplying alkaline liquid to the liquid portion of the vessel creates a pH of the liquid at 8 or above.

11. The method according to claim 1, wherein the step of preventing overcompression of the lignocellulosic material further comprises supplying gaseous material beneath the at least one column stress relief piece attached to a wall.

12. The method according to claim 1, wherein the step of feeding the feeding lignocellulosic material is controlled via feedback based upon a level of material in the vessel.

13. The method according to claim 12 further comprising the step of determining the level of material in the vessel via microwave level measurement.

14. The method according to claim 12 further comprising the step of determining the level of material in the vessel via gamma radiation measurement.

* * * * *